US005488773A

United States Patent [19]

Fletcher

[11] Patent Number: 5,488,773

[45] Date of Patent: Feb. 6, 1996

[54] MATERIAL SCORING APPARATUS

[76] Inventor: Donald C. Fletcher, 930 Sherman, Evanston, Ill. 60202

[21] Appl. No.: 386,427

[22] Filed: Feb. 10, 1995

[51] Int. Cl.[6] ..... B26B 29/06

[52] U.S. Cl. ..... 30/293; 30/292; 30/294

[58] Field of Search ..... 30/164.95, 292, 30/293, 294, 319, 320; 83/745, 885; 33/32.3, 42

[56] References Cited

U.S. PATENT DOCUMENTS

| | | | |
|---|---|---|---|
| 781,211 | 1/1905 | Kimkade | 30/164.95 X |
| 1,578,477 | 3/1926 | Smith et al. | 30/292 |
| 2,453,220 | 11/1948 | Gustafson . | |
| 2,529,210 | 11/1950 | Butler . | |
| 2,641,834 | 6/1953 | Bobrowski et al. . | |
| 2,706,002 | 4/1955 | Whittamore . | |
| 2,772,474 | 12/1956 | Hill et al. . | |
| 3,174,225 | 3/1965 | Abraham . | |
| 4,979,304 | 12/1990 | Sprague . | |
| 5,027,515 | 7/1991 | Murdock . | |
| 5,048,189 | 9/1991 | Aurness et al. . | |
| 5,083,375 | 1/1992 | Holm | 30/294 |
| 5,404,647 | 4/1995 | Drater | 30/293 |

OTHER PUBLICATIONS

Catalog Sheet, Stripper BS–21.

*Primary Examiner*—Douglas D. Watts
*Attorney, Agent, or Firm*—Marshall, O'Toole, Gerstein, Murray & Borun

[57] ABSTRACT

In order to facilitate a scoring of a sheet of material such as drywall, plasterboard, wallboard or the like, an apparatus includes a pair of arms each having an upper end and a lower end where the arms are spaced apart to define a sheet-receiving channel for receiving the sheet of material therebetween. The lower ends of the arms define an entry point for the sheet of material so the sheet of material can be placed between the arms and within the sheet-receiving channel with the sides generally perpendicular to a plane defined by the arms. The upper ends of the arms are connected to accommodate relative movement of the lower ends of the arms toward and away from one another. The apparatus includes a cutter for scoring at least one side of the sheet of material which is operatively associated with at least one of the arms at a point located generally remote from the upper end thereof. It also includes an elongated channel operatively associated with at least one of the arms for engaging the elongated edge of the sheet of material when it is positioned in the sheet-receiving channel. The elongated channel is positioned between the arms so as to guide the cutter along a line which extends generally parallel to the elongated edge of the sheet of material. The arms have a force applied to them at a point generally between the elongated channel and the upper ends of the arms to force the cutter into scoring engagement with the sheet of material. In order to make a tapered cut with the apparatus, a jig is provided in the form of a generally elongated channel-shaped guide carrying a stop that is adjustably positioned to cause the apparatus to be guided along a tapered line.

29 Claims, 5 Drawing Sheets

MATERIAL SCORING APPARATUS

BACKGROUND OF THE INVENTION

This invention relates to devices used for cutting drywall, plasterboard, wallboard, or other similar materials. Particularly, material such as gypsum wallboard which is relatively stiff, as supplied, usually in sections from four feet wide, one to sixteen feet long and ¼ to ¾" thick. Such wallboard sheets typically have paper surfaces on each face thereof enclosing the composition of the drywall between the faces.

It is often necessary to cut sheets of this type into narrower sections for use in building construction. Heretofore, the more common practice in carrying out this operation has been to mark the boards using rulers, squares, and chalk lines. It involves marking at several points down from the edge of the sheet, making a straight line along the material from marked point to marked point and then scoring the material along the line on one side of the drywall. Then, the desired panel is partially broken loose following which the panel is separated from the remainder of the sheet by scoring the opposite side along the crease which is formed opposite the first score line. The task requires using several tools consecutively. The tools must be kept in hand and delays can be encounter, when one of several is missing or lost. Such practice is time consuming and inefficient and also frequently results in an uneven edge line on the desired portion of the drywall that is to be mounted on the wall or ceiling.

DESCRIPTION OF THE PRIOR ART

U.S. Pat. No. 2,529,210 granted to J. F. Butler on Nov. 7, 1950 discloses a device for scoring both sides of a sheet of wallboard along a line on which the wallboard can be broken. The device consists of two cutting blades mounted on a frame defining a channel for receiving the wallboard to be cut. In use, the cutting blades are adjustable by extension and retraction to cut off a given width of board from the whole board. Thus, when so adjusted, the cutting device may be drawn over the edge of the board the full length of the board to cut off the given board width, but this device is awkward and clumsy to operate. Moreover, it does not provide for easy accommodation of sheets of drywall of varying thicknesses without further adjustment nor does it provide any means for applying a force to cause the cutting blades to be forced into engagement with the sheet of drywall.

U.S. Pat. No. 5,027,515 granted to C. F. Murdock on Jul. 2, 1991 discloses a device for goring both sides of a sheet of drywall along a line on which it can be broken. The device consists of a block-like configuration which slides over the edge of the sheet of drywall. As it moves along the edge, the device cuts both Sides of the sheet of drywall at the same distance from the edge simultaneously. The distance from the edge of the sheet of drywall being cut can be controllably varied from one-eighth inch to six inches. In the disclosed embodiment, the cutting block has at least four sharp cutting wheels, and the device is heavy and costly to manufacture. The inefficient design and weight has lead to the inclusion of an electric driven embodiment thereby further complicating the device and increasing its cost significantly. Further, Murdock does not provide for easy accommodation of sheets of drywall of varying thicknesses nor does it provide any means for applying a force to cause the cutting wheels to be forced into engagement with the sheet of drywall.

SUMMARY OF THE INVENTION

The present invention provides a means for cutting and/or scoring both sides of all sizes and thickness of sheet material in an efficient, reliable and exact manner without any need for reconfiguration or other significant readjustment as in the prior art devices. According to the invention, means are provided for easily setting the correct line of cut from an edge of the sheet of material to be cut. Furthermore, the present invention also provides a very stable scoring or marking tool which is advantageously characterized by its simple yet very effective design that lends to easily being manufactured in a highly cost effective manner. According to the invention, a tool is provided that is well balanced and easily controllable in a single hand of the operator without need of any complex structure. Clearly, this is important to any efficient drywall cutting device because an operator necessarily requires use of the other hand for the purpose of balancing the substantial weight of a sheet of drywall on one of its edges as the tool is being used. The present invention also provides a drywall scoring device which easily disassembles for storage in a specially designed storage case into: (1) a pair of arms joined at their upper ends; and (2) a drywall sheet edge engaging member releasably securable to one of the arms.

Accordingly, the present invention is directed to an apparatus for scoring a side of a sheet of material. The apparatus includes a pair of arms each having an upper end and a lower end. The arms are spaced apart to define a sheet-receiving channel for receiving the sheet of material therebetween and the lower ends of the arms define an entry point for an elongated edge of the sheet of material for placing the sheet of material between the arms and within the sheet-receiving channel such that the sides thereof are generally perpendicular to a plane defined by the arms. The apparatus also includes means for connecting the upper ends of the arms together. More specifically, the connecting means accommodates movement of the lower ends of the arms toward and away from one another.

In addition, the apparatus includes means for scoring at least one side of the sheet of material operatively associated with at least one of the arms at a point located generally remote from the upper end thereof. It further includes means operatively associated with at least one of the arms for engaging the elongated edge of the sheet of material when the sheet of material is positioned in the sheet-receiving channel between the arms to guide the scoring means along a line generally parallel to the elongated edge of the sheet of material. Still further, the apparatus includes means for applying a force to the arms at a point generally between the sheet edge engaging means and the upper ends of the arms to force the scoring means into scoring engagement with the sheet of material.

In the exemplary embodiment, the apparatus is well suited for measuring and scoring two sides of a sheet of drywall, plasterboard, wallboard, or like material. Preferably, the arms are of substantially equal length and are spaced apart to define a sheet-receiving channel of a preselected minimum width for receiving a sheet of material of any commercially available thickness therebetween. It is also advantageous for the lower ends of the arms to be capable of a maximum separation for receiving a sheet of material of any commercially available thickness. Preferably, the scoring means is operatively associated with each of the arm and includes cutter means mounted to the lower end of each of the arms. Additionally, the sheet edge engaging means is advantageously slidably associated with one of the arms and can be releasably secured in a selected position of adjustment along the arm.

In a most highly preferred embodiment, the apparatus includes means for releasably coupling and uncoupling at least a portion of the sheet edge engaging means to the arm. It is also highly advantageous for the apparatus to include means operatively associated with at least one of the arms for measuring and setting the vertical distance between the sheet edge engaging means and the scoring means. Still more specifically, the apparatus preferably includes measuring means operatively associated with both of the arms to permit measuring either from 0 to 24 inches or from 24 to 48 inches.

In a most highly preferred embodiment, the force applying means comprises a constant tension spring secured to and interconnecting the arms for providing constant compressive tension to the scoring means during a scoring operation. It is also advantageous for the apparatus to include means operatively associated with the scoring means for ensuring uniformity of scoring depth in a sheet of material entirely independent of the thickness of the sheet of material. In particular, the scoring means may advantageously comprise a cutter roller mounted to the lower end of each of the arms for rotation above an axis generally parallel to the axis of the respective one of the arms.

In another respect, the present invention is directed to an apparatus and jig for scoring a side of a sheet of material to make a tapered cut. The jig includes a generally elongated channel-shaped guide adapted to be positioned over an elongated edge of the sheet of material. The channel-shaped guide has an elongated web portion joining a pair of depending leg portions wherein the web portion is adapted to have a first end in engagement with the elongated edge of the sheet of material. The jig also includes means associated with the channel-shaped guide for adjustably positioning a second end of the elongated web portion in spaced relation to the elongated edge of the sheet of material. (With this arrangement, the apparatus is advantageously utilized as previously described with the exception of the sheet edge engaging means.)

In this embodiment, the apparatus includes means operatively associated with at least one of the arms for engaging the channel-shaped guide of the jig. The guide engaging means engages the channel-shaped guide when the sheet of material is positioned in the sheet-receiving channel between the arms and the jig is positioned over the elongated edge of the sheet of material. In this manner, the guide engaging means and jig serve to guide the scoring means along a line tapered in relation to the elongated edge of the sheet of material.

In a highly preferred embodiment, the jig is formed such that the adjustable positioning means comprises a stop disposed between the depending leg portions. The stop is advantageously supported for movement toward and away from the web portion at the second end thereof. Further, the jig preferably includes means for securing the stop in a selected position of adjustment relative to the second end of the web portion to guide the scoring means along the tapered line.

As for other details, the jig preferably includes a guide rail disposed on the web portion on the side opposite the depending leg portions. The guide engaging means then advantageously comprises an elongated channel of a thickness for receiving a sheet of material of any commercially available thickness therebetween. In addition, the elongated channel preferably has a plurality of longitudinally spaced rollers to be placed in engagement with the guide rail to facilitate movement of the apparatus therealong.

Still other objects, advantages and features of the present invention will become apparent to those skilled in the art from a consideration of the following specification taken in conjunction with the accompanying drawings.

DETAILED DESCRIPTION OF THE PREFERRED EMBODIMENT

Figure 1:
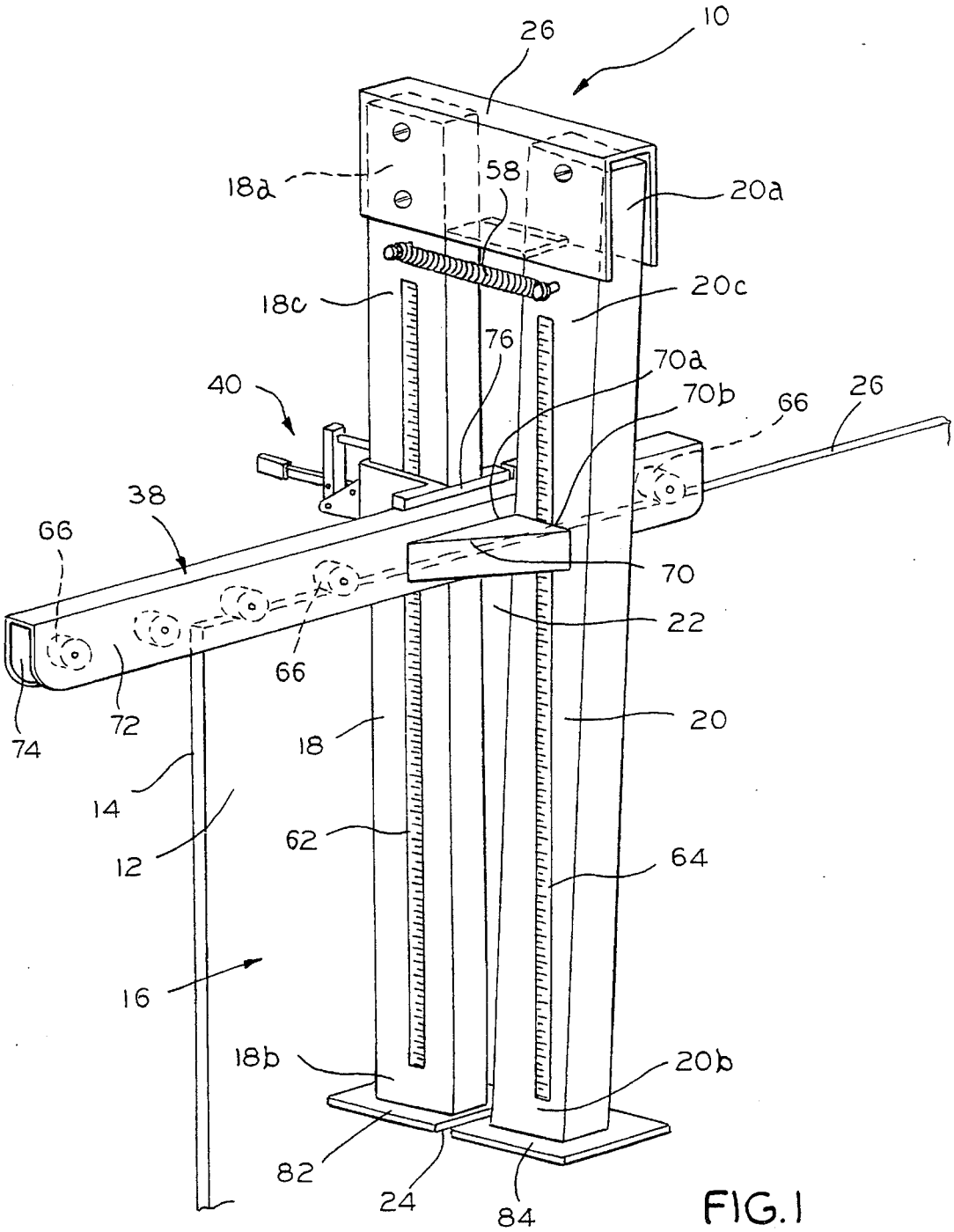
FIG. 1 is a perspective view of a material scoring apparatus with grip means removed in accordance with the present invention.

Referring to the drawings, and first to FIG. 1, the reference number 10 designates generally an apparatus for measuring and scoring two sides 12 and 14 of a sheet of drywall, plasterboard, wallboard, or like material 16. The apparatus 10 includes a pair of arms 18 and 20 each having an upper end **18*a* and 20*a* and a lower end 18*b* and 20*b*, respectively with the arms 18 and 20 being of substantially equal length. The arms 18 and 20 are spaced apart to define a sheet-receiving channel 22 of a preselected minimum width for receiving the sheet of material 16 which may be of any commercially available thickness and the lower ends 18*b* and 20*b* of the arms 18 and 20 define an entry point as at 24 for an elongated edge 26 of the sheet of material 16 capable of a maximum separation for receiving the sheet of material 16 which, again, may be of any commercially available thickness. The apparatus 10 is such that the entry point 24 makes it possible to place the sheet of material 16 between the arms 18 and 20 and within the sheet-receiving channel 22. Still more specifically, the sheet of material 16 may be placed between the arms 18 and 20 such that the sides 12 and 14 are generally perpendicular to a plane defined by the arms 18 and 20 (see, also, FIG. 2**).

Figure 2:
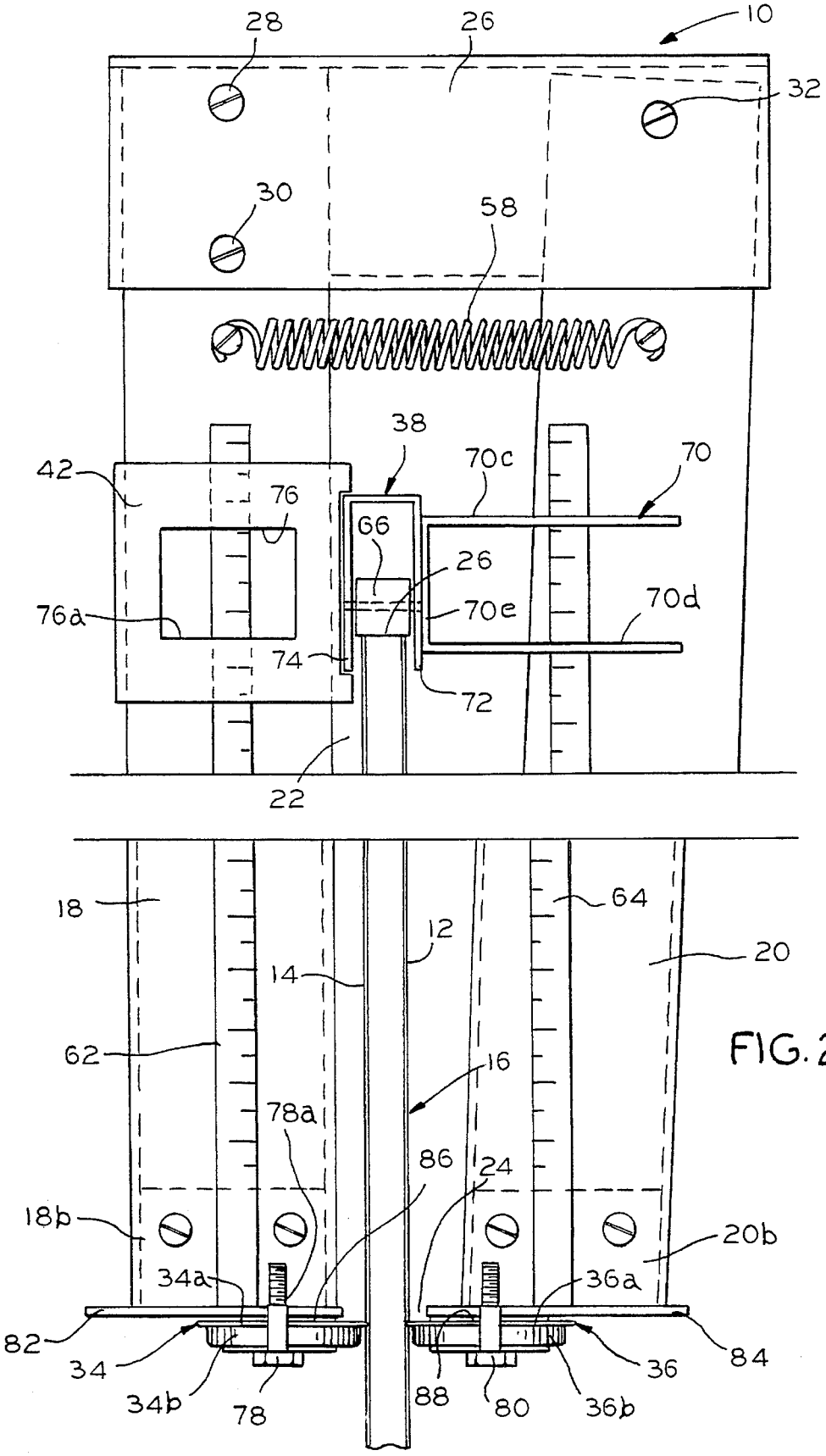
FIG. 2 is a front elevational view, partly broken away, of the material scoring apparatus as illustrated in FIG. 1.

As will be appreciated from FIGS. 1 and 2, the apparatus 10 preferably includes a connecting bracket 26 for joining the upper ends **18*a* and 20*a* of the arms 18 and 20 to accommodate relative movement of the lower ends 18*b* and 20*b* of the arms 18 and 20 toward and away from one another. Preferably, the arm 18 is rigidly secured to the connecting bracket 26 by a pair of fasteners 28 and 30** whereas the arm 20 is secured to the connecting bracket 26 by a single fastener 32. As will be appreciated, this makes it possible for the lower end 20*b* of the arm 20 to pivot about an axis defined by the fastener 32 toward and away from the lower end 18*b* of the arm 18.

Figure 5:
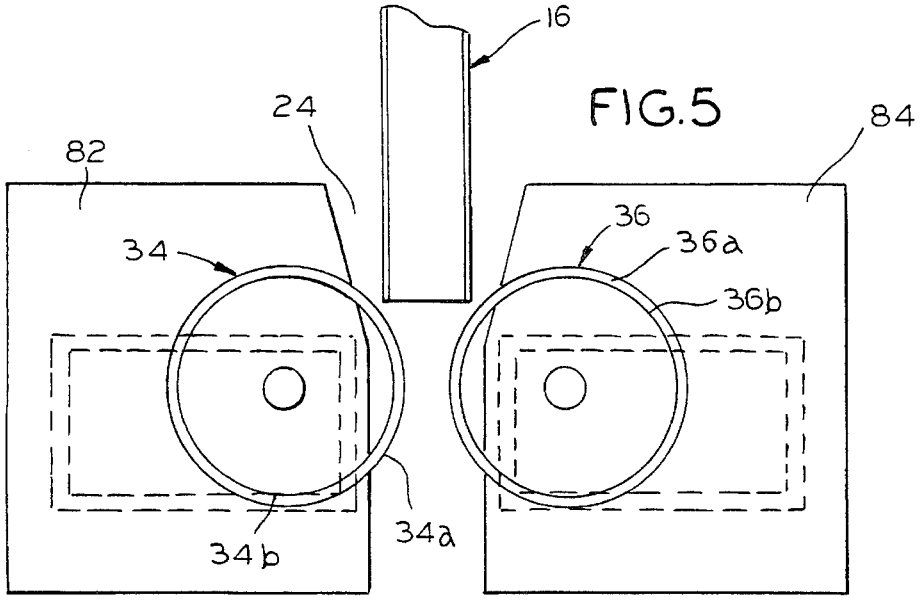
FIG. 5 is a bottom plan view of the material scoring apparatus of FIG. 1.

Referring to FIGS. 2 and 5, the apparatus 10 will be understood to include means for scoring the sides 12 and 14 of the sheet of material 16 operatively associated with each of the arms 18 and 20 including cutter means 34 and 36 mounted to the lower end 18*b* and 20*b* of each of the arms 18 and 20. The cutter means 34 and 36 may suitably comprise cutter rollers, substantially as shown, which are mounted to the lower end 18*b* and 20*b* of each of the arms 18 and 20 for rotation about an axis which will be understood to be generally parallel to the axis of the respective one of the arms 18 and 20. Each of the cutter rollers 34 and 36 is positioned opposite to and coplanar with the other of the cutter rollers in a plane generally perpendicular to the plane defined by the arms 18 and 20 so as to also be perpendicular to the sheet of material 16. Each of the cutter rollers 34 and 36 also has a peripheral cutting edge 34*a* and 34*b* which will be seen to be generally aligned and extending inwardly beyond the arms 18 and 20 into the sheet-receiving channel 22 to score each of the sides 12 and 14 of the sheet of material 16. Still additionally, FIG. 2 illustrates that the apparatus 10 includes means for ensuring uniform scoring depth in the form of roller guides 34*b* and 36*b* arranged so as to be concentric with and slightly smaller in diameter than the diameter of the corresponding one of the cutter rollers 34*a* and 34*b*.

Figure 3:
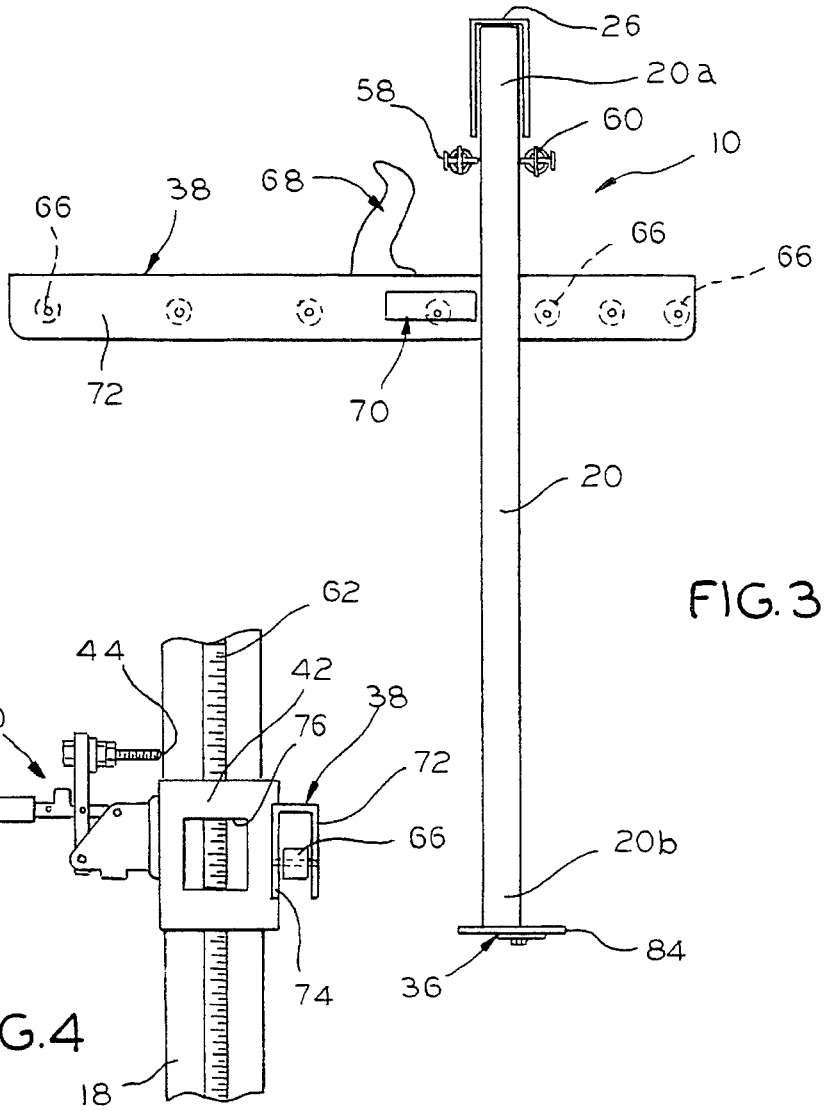
FIG. 3 is a side elevational view of the material scoring apparatus of FIG. 1 having a grip.
Figure 4:
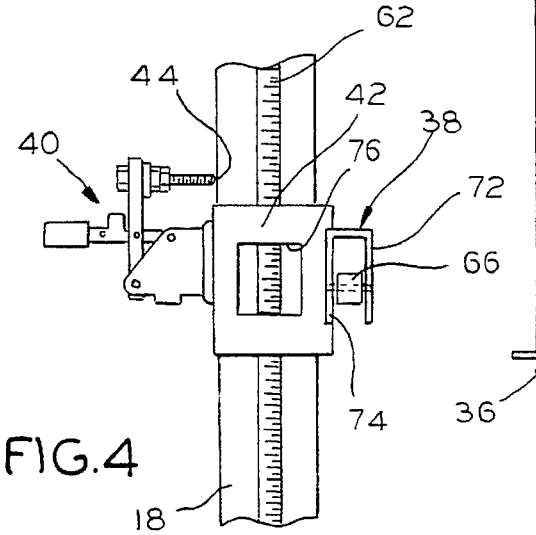
FIG. 4 is an enlarged front elevational view of an adjustment mechanism for the material scoring apparatus as illustrated in FIG. 1.

As shown in FIGS. 1–3, the apparatus 10 includes means operatively associated with one of the arms 18 for engaging the elongated edge 26 of the sheet of material 16 when the sheet of material 16 is positioned in the sheet-receiving channel 22 between the arms 18 and 20 to guide the cutter rollers 34 and 36 along a line extending generally parallel to and spaced from the elongated edge 26 of the sheet of material 16. The side edge engaging means comprises an elongated channel generally designated 38 having a width sufficient for engaging the elongated edge 16 of a sheet of any commercially available thickness for a scoring operation. Referring specifically to FIGS. 1, 2 and 4, the elongated channel 38 will be understood as being slightably associated with one of the arms 18 and including means for releasably securing the elongated channel 38 in a selected position of adjustment along the arm 18 as well as means for releasably coupling and uncoupling at least a portion of the elongated channel 38 to the arm 18.

Figure 7:
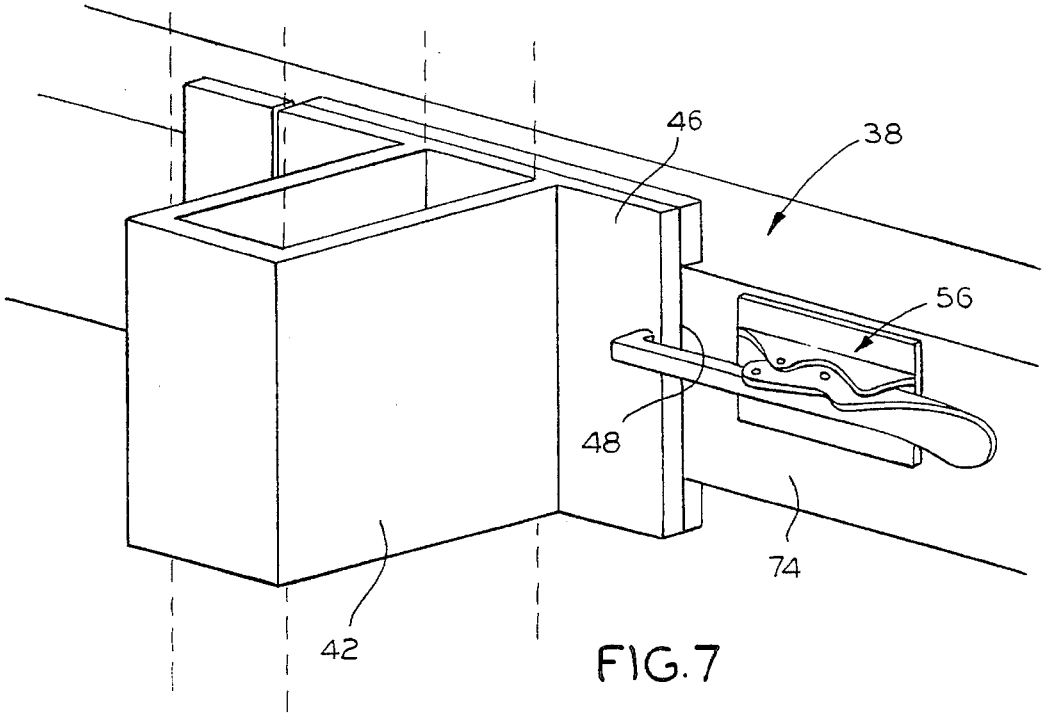
FIG. 7 is a perspective view of a releasable securing mechanism in a locked position.
Figure 6:
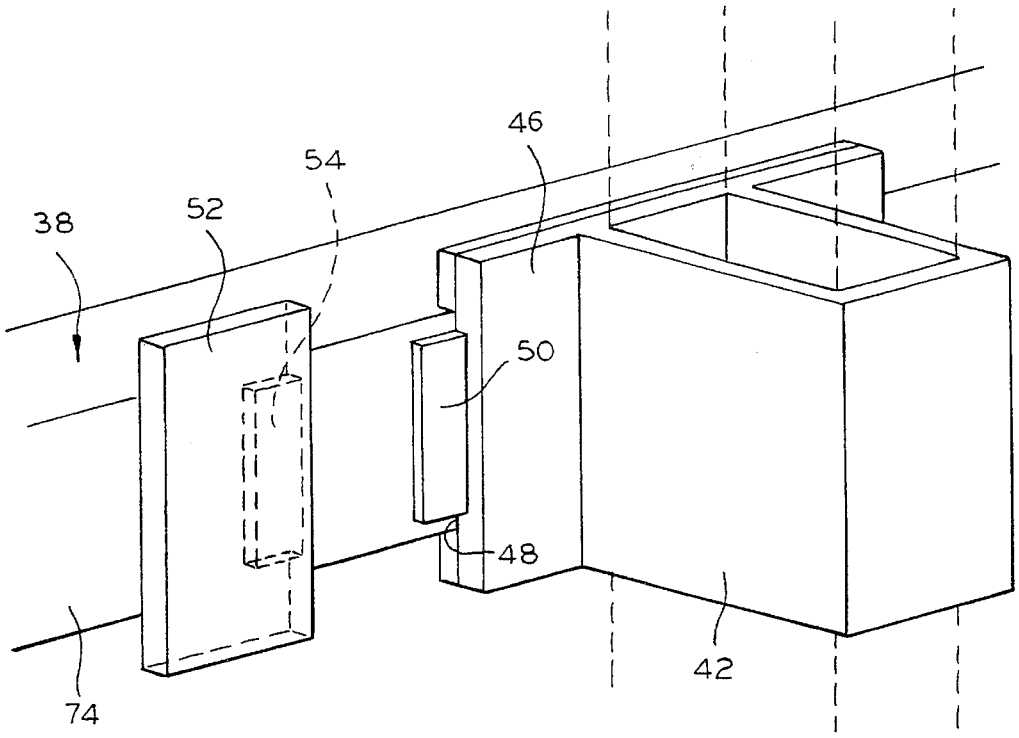
FIG. 6 is a perspective view of a releasable securing mechanism in an unlocked position.

More specifically, the releasable securing means for the elongated channel 38 comprises a quick-release clamp 40 disposed on a slide collar 42 for engaging the arm 18 on which the elongated channel 38 is slightably associated in any position along its length such as 44 shown in FIG. 4. It will be appreciated that the quick release clamp 40 is of a conventional type and may be advantageously utilized with the present invention, although other such quick release clamping means also may be employed as desired. Referring to FIGS. 6 and 7, the coupling and uncoupling means comprises an internal plate 46 associated with a slide collar 42 which has a recess 48 to receive the elongated channel together with means for locking the elongated channel 38 within the recess 48. It will be appreciated that the locking means will suitably comprise a tong 50 extending from the internal plate 46 parallel to the recess 48 and a plate 52 on the elongated channel 38 having an opening 54 for receiving the tong 50 therewithin. By comparing FIGS. 6 and 7, it will be appreciated that the elongated channel may be moved from the position shown in FIG. 6 within the recess 48 until the tong 50 is disposed within the opening 54 to the position as shown in FIG. 7.

Referring specifically to FIG. 7, the means for locking the elongated channel 38 within the recess 48 further includes a quick release clamp 56. The clamp 56 will be understood to be disposed on the elongated channel 38 in spaced relation to the plate 52 on the elongated channel 38. In this manner, the quick release clamp 56 is adapted for engagement with the internal plate 46 associated with the slide collar 42 after the tong 50 has been received within the opening 54.

Referring once again to FIGS. 1–3, the apparatus 10 will be understood to include a constant tension spring 58 secured to and interconnecting each of oppositely facing parallel surfaces 18*c* and 20*c* of the arms 18 and 20. It will be appreciated that the spring 58 applies a constant force to the arms 18 and 20 at a point generally between the elongated channel 38 and the connecting bracket 26, and preferably near the connecting bracket 26, to force the cutter rollers 34 and 36 into scoring engagement with the sheet of material 16. In the preferred embodiment, the apparatus 10 will also include a constant tension spring 60 on the opposite parallel surfaces of the arms 18 and 20 substantially as shown in FIG. 3.

As will be best appreciated from FIGS. 1 and 2, the apparatus 10 includes means operatively associated with at least one of the arms 18 for measuring and setting the vertical distance between the elongated channel 38 and the cutter rollers 34 and 36. Preferably, the measuring means takes the form of integral measuring indicia 62 and 64 integral with both of the arms 18 and 20 for measuring and setting the vertical distance. Advantageously, the measuring indicia 62 measures from 0 to 24 inches from the cutter roller 34 to near the upper end 18*a* of one of the arms 18 and from 24 to 48 inches from near the upper end 20*a* of the other of the arms 20 to the cutter roller 36.

As clearly shown in FIGS. 1–3, the elongated channel 38 will be seen to include a plurality of longitudinally spaced rollers 66. These rollers 66 are adapted to be placed in engagement with the elongated edge 26 of the sheet of material 16 (see FIG. 2) to facilitate rolling movement of the elongated channel 38 therealong. As will be appreciated, the longitudinally spaced rollers 66 provide a minimum of frictional resistance to movement and, thus, facilitate the scoring of the material 16 that is produced by the cutter rollers 34 and 36.

In order to produce this movement, the apparatus 10 may include suitable grip means 68 (see FIG. 3). The grip means 68 may advantageously take the form of a contoured handle integrally associated with the elongated channel 38. In any event, the grip means 68 accommodates pushing the elongated channel 38 along the elongated edge 26 of the sheet of material 16 during a scoring operation.

As for other details on the invention, the apparatus 10 includes means operatively associated with the elongated channel 38 for maintaining alignment of the first and second arms 18 and 20 during a scoring operation. This advantageously takes the form of a generally triangular-shaped projection 70 on a side wall 72 of the elongated channel 38 where the projection defines a substantially right angle with one of the legs 70*a* integral with the side wall 72 of the elongated channel 38 and the other of the legs 70*b* adapted to abut the surface 20*c* of the leg 20. If the grip means 68 shown in FIG. 3 is used to exert a pushing force toward the arms 18 and 20, the leg 70*b* of the triangular projection 70 abuts the surface 20*c* of the arm 20 to maintain a coplanar relationship for the arms 18 and 20.

With regard to the construction of the apparatus 10, the springs 58 and 60 provide constant compressive spring tension to assist the cutter rollers 34 and 36 in biting into and scoring the sides 12 and 14 of the sheet of material 16 entirely independent of the thickness thereof. It will also be appreciated that the elongated channel 38 is essentially guided along the elongated edge 26 of the sheet of material 16 and prevented from tipping in a fore or aft direction due to the positioning of the elongated edge 26 of the sheet of material 16 within the channel defined by the side walls 72 and 74 as well as engagement of the elongated edge 26 with the rollers 66 disposed therebetween. As previously mentioned, the longitudinally spaced rollers 66 cause the elongated channel 38 to more easily glide along the elongated edge 26 of the sheet of material 16 due to the very low surface friction.

With regard to the triangular projection 70, it comprises a triangular support wedge which is integrally secured to the side wall 72 of the elongated channel 38. This triangular support wedge contacts and supports the surface 20*c* of the arm 20 so as to maintain the arms 18 and 20 in alignment and, thus, to maintain the cutter rollers 34 and 36 in alignment. As alternatives, the triangular support wedge 70 may be replaced with a transversely extending bar or other similar elements that physically contact and brace the surface 20*c* of the arm 20 during a scoring operation.

As previously suggested, the arm 20 is pivotably attached to the connecting bracket 26 for movement toward and away from the other arm 18. This pivotal movement allows for variable separation of the arms 18 and 20 and, thus, variable width of the sheet-receiving channel 22 to accommodate a sheet of material 16 of any commercially available thickness. In addition, the pivotal movement of the arm 20 is such that the lower end 20*b* can be separated from the lower end 18*b* of the arm 18 to accommodate receiving a sheet of material 16 of any commercially available thickness through the entry point 24.

With regard to the measuring means, it may be operable in any of a number of different ways. It will be seen from FIG. 2 that the slide collar 42 may be provided with a window 76 having a lower edge 76*a* corresponding to the precise point where the rollers 66 contact the elongated edge 26 of the sheet of material 16. In this manner, if the cutter rollers 34 and 36 are at the "0" point, the reading of the measuring indicia 62 at the lower edge 76*a* of the window 76 will be the width of the cut that is being made with the apparatus 10.

Similarly, the triangular support wedge 70 may be formed to have an upper flange 70*c* and a lower flange 70*d* as well as an interconnecting web 70*e* (see FIG. 2). The lower flange 70*d* may be such that the upper surface thereof is positioned precisely where the rollers 66 contact the elongated edge 26 of the sheet of material 16. With this arrangement, the reading at the upper surface of the flange 70*d* on the measuring indicia 64 will constitute the width from the cutter rollers 34 and 36 to the elongated edge of the sheet of material 16 directly opposite the elongated edge 26.

In other words, the measuring indicia 62 may be utilized to directly measure the width of the piece being cut from the elongated edge 26 to the cutter rollers 34 and 36 whereas the measuring indicia 64 may be utilized to directly measure the piece being cut from the opposite, parallel elongated edge of the sheet of material 16 to the cutter rollers 34 and 36.

Referring to FIGS. 1, 2 and 5, the cutter rollers 34 and 36 may advantageously be secured to the lower ends 18*b* and 20*b* of the arms 18 and 20 by means of suitable threaded bolts 78 and 80. It will be appreciated that these bolts will have shoulders as at 78*a* and 80*a* that will limit the degree of insertion into the lower ends 18*b* and 20*b* of the arms 18 and 20 so as to permit relatively free rotation of the cutter rollers 34 and 36 as the apparatus 10 is moved along the sheet of material 16. In addition, the apparatus 10 may include oversized generally rectangular plates 82 and 84 having angled cutouts 82*a* and 84*a* to define the entry point 24 for directing the sheet of material 16 between the cutter rollers 34 and 36.

With regard to the oversized plates 82 and 84, it will be appreciated that they protect the cutter rollers 34 and 36 by allowing exposure of only the necessary portion of the cutting edges 34*a* and 36*a*. It will also be appreciated that the cutter rollers 34 and 36 may be spaced from the rectangular 82 and 84 as by washers 86 and 88. As for still other details of construction, they will be readily apparent to those skilled in the art and need not be set forth in detail herein.

Figures 8, 9, 10:
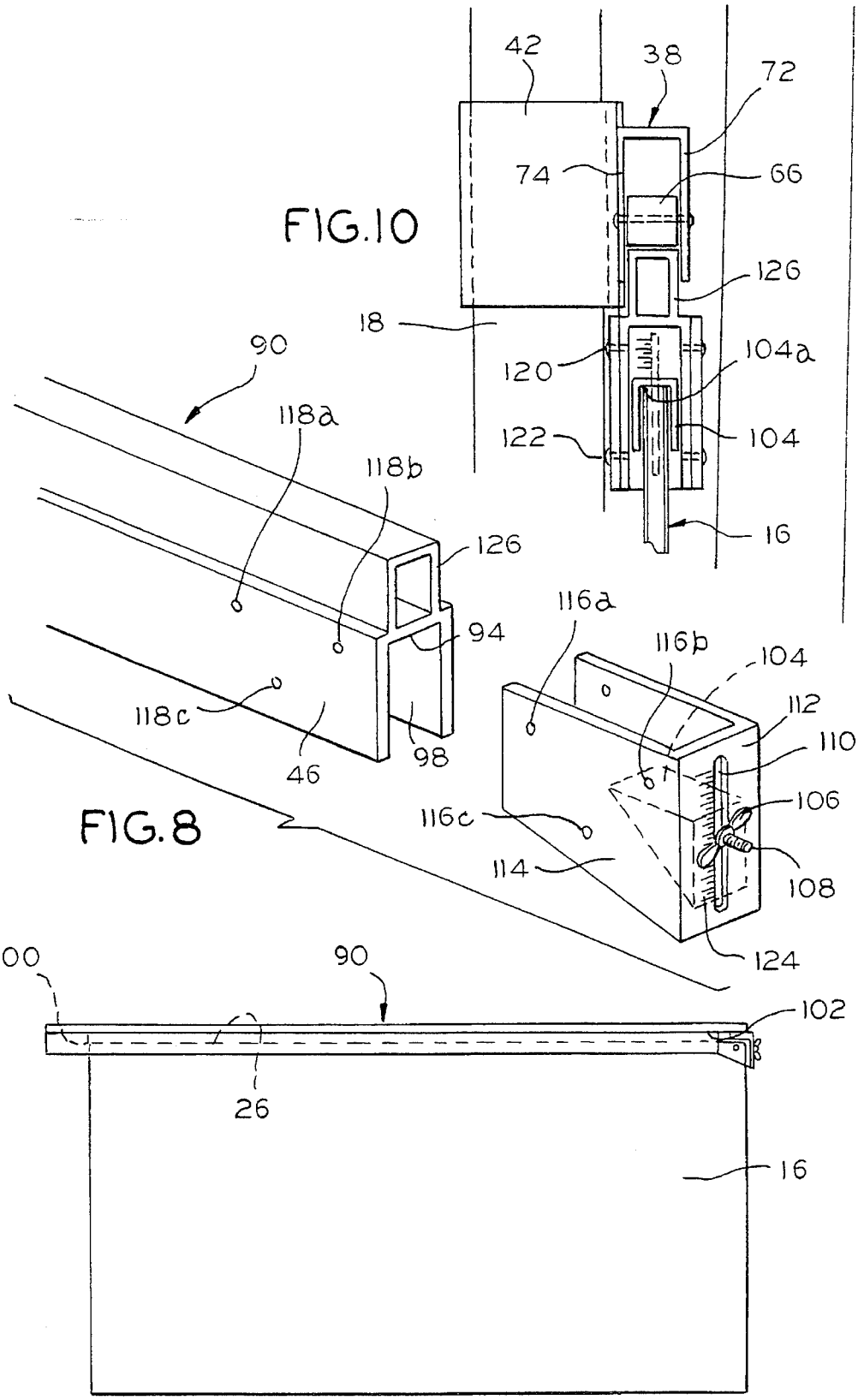
FIG. 8 is an exploded perspective view of a jig for use with the material scoring apparatus of FIG. 1.
FIG. 9 is a side elevational view of the jig of FIG. 8 in position on a sheet of material.
FIG. 10 is an end elevational view of the jig of FIG. 8 in use with the material scoring apparatus as illustrated in FIG. 1.

Referring now to FIGS. 8–10, still another aspect of the present invention will be appreciated wherein a jig 90 has been illustrated. The jig 90 includes a generally elongated channel-shaped guide 92 adapted to be positioned over the elongated edge 26 of the sheet of material 16. The channel-shaped guide 92 has an elongated web portion 94 joining a pair of depending leg portions 96 and 98. The elongated web portion 94 is adapted to have a first end 100 in engagement with the elongated edge 26 of the sheet of material 16. Still additionally, the jig 90 includes means associated with the channel-shaped guide 92 for adjustably positioning a second end 102 of the elongated web portion 94 in spaced relation to the elongated edge 26 of the sheet of material 16.

As best shown in FIG. 8, the adjustable positioning means comprises a stop 104 disposed between the depending leg portions 96 and 98 (see, also, FIG. 10). The stop 104 is supported for movement toward and away from the web portion 94 at the second end 102 thereof, preferably by means of a wing nut 106 on a threaded bolt 108 disposed through a slot 110 in the end wall 112 of a stop-carrying bracket 114 having a plurality of holes 116*a–c* adapted to be aligned with corresponding holes 118*a–c* through which suitable fasteners such as 120 and 122 may be disposed to secure the bracket 112 to the depending leg portions 96 and 98.

In the illustrated embodiment, the stop 104 is generally triangular-shaped to have a sheet-engaging surface 104*a* it will be seen that the bracket 112 may have a measurement indicia 124 adjacent the slot 110 to allow the user to set the position of the feed engaging surface 104*a* to thereby adjust the degree of taper. In this manner, the stop 104 serves to establish the angle of the jig 90 relative to the elongated edge 26 of the sheet of material 16 to guide the cutter rollers 34 and 36 of the apparatus 10 along a tapered line.

Referring to FIGS. 8 and 10, the jig 90 includes a guide rail 126 disposed on the web portion 94 on the side opposite the depending leg portions 96 and 98. The elongated channel 38 which, as previously described, serve to engage the elongated edge 26 of the sheet of material 16, now comprises an elongated channel of a width for receiving the guide rail 126 of the jig 90 therebetween. As before, the elongated channel 38 has a plurality of longitudinally spaced rollers 66 to be placed in engagement with the guide rail 126 to facilitate movement of the apparatus 10 therealong.

While in the foregoing there has been set forth a preferred embodiment of the invention, it will be appreciated that the details herein given may be varied by those skilled in the an without departing from the true spirit and scope of the appended claims.

I claim:

1. An apparatus for scoring a side of a sheet of material, comprising:

a pair of arms each having an upper end and a lower end, the arms being spaced apart to define a sheet-receiving channel for receiving the sheet of material therebetween and the lower ends of the arms defining an entry point for the sheet of material so the sheet of material can be placed between the arms and within the sheet-receiving channel such that the sides thereof are generally perpendicular to a plane defined by the arms, and including means for connecting the upper ends of the arms to accommodate relative movement of the lower ends of the arms toward and away from one another;

means for scoring at least one side of the sheet of material operatively associated with at least one of the arms at a point located generally remote from the upper end thereof;

means operatively associated with at least one of the arms for engaging the elongated edge of the sheet of material when the sheet of material is positioned in the sheet-receiving channel between the arms to guide the scoring means along a line generally parallel to the elongated edge of the sheet of material; and means for applying a force to the arms at a point generally between the sheet edge engaging means and the upper ends of the arms to force the scoring means into scoring engagement with the sheet of material.

2. The apparatus as defined in claim 1 wherein the pair of arms are of substantially equal length and the scoring means comprises cutter rollers mounted to the lower end of each of the arms for scoring each of the sides of the sheet of material.

3. The apparatus as defined in claim 1 wherein the force applying means comprises a constant tension spring secured to and interconnecting the arms for providing constant compressive tension to the scoring means during a scoring operation.

4. The apparatus as defined in claim 1 wherein the sheet edge engaging means is slidably associated with one of the arms generally between the arms and including means for releasably securing the sheet edge engaging means in a selected position of adjustment along the arm.

5. The apparatus as defined in claim 1 wherein the sheet-receiving channel is of a minimum width and the entry point is capable of a maximum separation sufficient to receive a sheet of any commercially available thickness for a scoring operation.

6. The apparatus as defined in claim 1 including means operatively associated with the scoring means for ensuring uniformity of scoring depth in a sheet of material entirely independent of the thickness of the sheet of material.

7. The apparatus as defined in claim 1 including means operatively associated with at least one of the arms for measuring and setting the vertical distance between the sheet edge engaging member and the scoring means.

8. The apparatus as defined in claim 1 wherein the scoring means comprise a cutter roller mounted to the lower end of each of the arms for rotation about an axis generally parallel to the axis of the respective one of the arms.

9. An apparatus for measuring and scoring two sides of a sheet of drywall, plasterboard, wallboard, or like material, comprising:

a pair of arms each having an upper end and a lower end and being of substantially equal length, the arms being spaced apart to define a sheet-receiving channel of a preselected minimum width for receiving a sheet of material of any commercially available thickness therebetween and the lower ends of the arms defining an entry point for an elongated edge of the sheet of material capable of a maximum separation for receiving a sheet of material of any commercially available thickness for placing the sheet of material between the arms and within the sheet-receiving channel such that the sides thereof are generally perpendicular to a plane defined by the arms, and including means for connecting the upper ends of the arms to accommodate relative movement of the lower ends of the arms toward and away from one another;

means for scoring the sides of the sheet of material operatively associated with each of the arms including cutter means mounted to the lower end of each of the arms;

means operatively associated with one of the arms for engaging the elongated edge of the sheet of material when the sheet of material is positioned in the sheet-receiving channel between the arms to guide the scoring means along a line extending generally parallel to and spaced from the elongated edge of the sheet of material, the sheet edge engaging means being slidably associated with one of the arms and including means for releasably securing the sheet edge engaging means in a selected position of adjustment along the arm and including means for releasably coupling and uncoupling at least a portion of the sheet edge engaging means to the arm;

means for applying a force to the arms at a point generally between the sheet edge engaging means and the upper ends of the arms to force the scoring means into scoring engagement with the sheet of material; and means operatively associated with at least one of the arms for measuring and setting the vertical distance between the sheet edge engaging means and the scoring means.

10. The apparatus as defined in claim 9 including means operatively associated with the scoring means for ensuring uniformity of scoring depth in a sheet of material entirely independent of the thickness of the sheet of material.

11. The apparatus as defined in claim 9 wherein the sheet edge engaging means comprises an elongated channel having a width for engaging the elongated edge of a sheet of material of any commercially available thickness for a scoring operation.

12. The apparatus as defined in claim 9 wherein the scoring means comprise a cutter roller mounted to the lower end of each of the arms for rotation about an axis generally parallel to the axis of the respective one of the arms.

13. The apparatus as defined in claim 12 wherein each of the cutter rollers is positioned opposite to and coplanar with the other of the cutter rollers in a plane generally perpendicular to the plane defined by the arms so as to be perpendicular to the sheet of material.

14. The apparatus as defined in claim 12 wherein the cutter rollers have generally aligned peripheral cutting edges extending inwardly beyond the arms into the sheet-receiving channel to score each of the sides of the sheet of material.

15. The apparatus as defined in claim 12 including means for ensuring uniform scoring depth comprising a roller guide arranged so as to be concentric with and slightly smaller in diameter than the diameter of each of the cutter rollers.

16. The apparatus as defined in claim 9 including means operatively associated with the sheet edge engaging means for maintaining alignment of the first and second arms during a scoring operation to thereby maintain alignment of the scoring means.

17. An apparatus for measuring and scoring two sides of a sheet of drywall, plasterboard, wallboard, or like material, comprising:

a pair of arms each having an upper end and a lower end and being of substantially equal, length, the arms being spaced apart to define a sheet-receiving channel of a preselected minimum width for receiving a sheet of material of any commercially available thickness therebetween and the lower ends of the arms defining an entry point for an elongated edge of the sheet of material capable of a maximum separation for receiving a sheet of material of any commercially available thickness for placing the sheet of material between the arms and within the sheet-receiving channel such that the sides thereof are generally perpendicular to a plane defined by the arms, and including a connecting bracket for joining the upper ends of the arms to accommodate relative movement of the lower ends of the arms toward and away from one another;

means for scoring the sides of the sheet of material operatively associated with each of the arms including cutter means mounted to the lower end of each of the arms;

means operatively associated with one of the arms for engaging the elongated edge of the sheet of material when the sheet of material is positioned in the sheet-receiving channel between the arms to guide the scoring means along a line extending generally parallel to and spaced from the elongated edge of the sheet of material, the sheet edge engaging means comprising an elongated channel having a width for engaging the elongated edge of a sheet of any commercially available thickness for a scoring operation, the elongated channel being slidably associated with one of the arms and including means for releasably securing the elongated channel in a selected position of adjustment along the arm and including means for releasably coupling and uncoupling at least a portion of the elongated channel to the arm;

a constant tension spring secured to and interconnecting each of oppositely facing parallel surfaces of the arms for applying a constant force to the arms at a point generally between the elongated channel and the connecting bracket to force the scoring means into scoring engagement with the sheet of material; and means operatively associated with at least one of the arms for measuring and setting the vertical distance between the elongated channel and the scoring means.

18. The apparatus as defined in claim 17 including means operatively associated with the scoring means for ensuring uniformity of scoring depth in a sheet of material entirely independent of the thickness of the sheet of material.

19. The apparatus as defined in claim 17 including measuring means operatively associated with both of the arms for measuring and setting the vertical distance between the elongated channel and the scoring means.

20. The apparatus as defined in claim 19 wherein the measuring means measures from 0 to 24 inches from the scoring means to near the upper end of one of the arms and from 24 to 48 inches from near the upper end of the other of the arms to the scoring means.

21. The apparatus as defined in claim 17 wherein the releasable securing means for the elongated channel comprises a clamp disposed on a slide collar for engaging the arm on which the elongated channel is slidably associated.

22. The apparatus as defined in claim 21 wherein the coupling and uncoupling means comprises an internal plate associated with the slide collar having a recess to receive the elongated channel and means for locking the elongated channel within the recess.

23. The apparatus as defined in claim 22 wherein the locking means comprises a tongue extending from the internal plate parallel to the recess and a plate on the elongated channel having an opening for receiving the tongue therewithin.

24. The apparatus as defined in claim 23 wherein the locking means further includes a clamp disposed on the elongated channel in spaced relation to the plate on the elongated channel for engagement with the internal plate associated with the slide collar.

25. The apparatus as defined in claim 17 wherein said elongated channel includes a plurality of longitudinally spaced rollers to be placed in engagement with the elongated edge of the sheet of material to facilitate movement of the elongated channel therealong.

26. The apparatus as defined in claim 17 including grip means operatively associated with the elongated channel for pushing the elongated channel along the elongated edge of the sheet of material during a scoring operation.

27. An apparatus and jig for scoring a side of a sheet of material to make a tapered cut, wherein the jig comprises:

a generally elongated channel-shaped guide adapted to be positioned over an elongated edge of the sheet of material, the channel-shaped guide having an elongated web portion joining a pair of depending leg portions, the elongated web portion being adapted to have a first end in engagement with the elongated edge of the sheet of material; and means associated with the channel-shaped guide for adjustably positioning a second end of the elongated web portion in spaced relation to the elongated edge of the sheet of material; and wherein the apparatus comprises:

a pair of arms each having an upper end and a lower end, the arms being spaced apart to define a sheet-receiving channel for receiving the sheet of material therebetween and the lower ends of the arms defining an entry point for an elongated edge of the sheet of material for placing the sheet of material between the arms and within the sheet-receiving channel such that the sides thereof are generally perpendicular to a plane defined by the arms, and including means for connecting the upper ends of the arms to accommodate relative movement of the lower ends of the arms toward and away from one another;

means for scoring at least one side of the sheet of material operatively associated with at least one of the arms at a point located generally remote from the upper end thereof;

means operatively associated with at least one of the arms for engaging the channel-shaped guide when the sheet of material is positioned in the sheet-receiving channel between the arms to guide the scoring means along a line tapered in relation to the elongated edge of the sheet of material; and means for applying a force to the arms at a point generally between the sheet edge engaging means and the upper ends of the arms to force the scoring means into scoring engagement with the sheet of material.

28. The apparatus and jig as defined in claim 27 wherein the adjustable positioning means comprises a stop disposed between the depending leg portions, the stop being supported for movement toward and away from the web portion at the second end thereof, and means for securing the stop in a selected position of adjustment relative to the second end of the web portion whereby the scoring means is guided along the tapered line.

29. The apparatus and jig as defined in claim 27 further including a guide rail disposed on the web portion on the side opposite the depending leg portions, the guide engaging means comprising an elongated channel of a width for receiving the guide rail therebetween, the elongated channel having a plurality of longitudinally spaced rollers to be placed in engagement with the guide rail to facilitate movement of the apparatus therealong.

* * * * *

UNITED STATES PATENT AND TRADEMARK OFFICE

CERTIFICATE OF CORRECTION

PATENT NO. : 5,488,773

DATED : February 6, 1996

INVENTOR(S) : DONALD C. FLETCHER

It is certified that error appears in the above-identified patent and that said Letters Patent is hereby corrected as shown below:

column 1, line 25, replace "encounter", with --encountered--; and column 1, line 51, replace "goring" with --scoring--.

Signed and Sealed this

Twenty-third Day of July, 1996

*Attest:*

Bruce Lehman

BRUCE LEHMAN

*Attesting Officer*

*Commissioner of Patents and Trademarks*